United States Patent [19]

van Ditshuizen

[11] 4,221,439

[45] Sep. 9, 1980

[54] MOUNTING FOR THE SHAFT OF AN OPEN-END SPINNING ROTOR

[75] Inventor: Henri van Ditshuizen, Ingolstadt, Fed. Rep. of Germany

[73] Assignee: Schubert & Salzer, Ingolstadt, Fed. Rep. of Germany

[21] Appl. No.: 894,110

[22] Filed: Apr. 6, 1978

[30] Foreign Application Priority Data

Apr. 9, 1977 [DE] Fed. Rep. of Germany ... 7711363[U]

[51] Int. Cl.[2] ..... F16C 9/06

[52] U.S. Cl. ..... 308/166; 57/58.89; 308/149; 308/172

[58] Field of Search ..... 308/146, 149, 156, 158, 308/166, 169, 172, 228, 229, 230, 232, 233; 57/58.89

[56] References Cited

FOREIGN PATENT DOCUMENTS 2061462 6/1972 Fed. Rep. of Germany ..... 57/58.89

2317306 10/1974 Fed. Rep. of Germany ..... 57/58.89

*Primary Examiner*—Charles E. Frankfort

*Attorney, Agent, or Firm*—Bailey, Dority & Flint

[57] ABSTRACT

A mounting for the shaft of an open-end spinning rotor which by means of axial thrust is pressed at its end against a ball that is carried by a unilateral attached support. A stablizing screw contacts the support in a direction opposite from the direction of the axial thrust of the shaft on the support.

2 Claims, 1 Drawing Figure

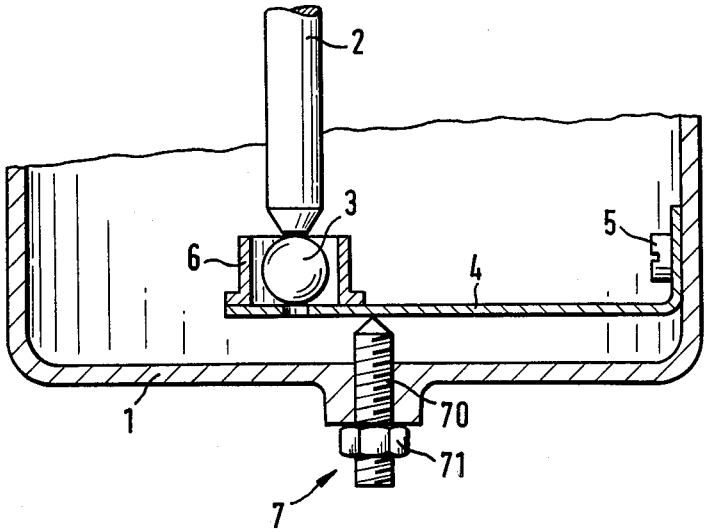
2
3
5
6
4
1
70
71
7

MOUNTING FOR THE SHAFT OF AN OPEN-END SPINNING ROTOR

BACKGROUND OF THE INVENTION

The present invention relates to mounting for the shaft of an open-end spinning rotor, which by means of axial thrust is pressed at its end against a ball that is carried within a unilaterally attached support.

It is well known to support the shaft of an open-end spinning rotor in a V-shaped groove on one of a pair of support plates and by means of axial thrust to press it with its end against a ball serving as a thrust bearing. The thrust bearing is carried by a unilaterally attached support in close proximity to its free end (U.S. Pat. No. 3,951,479 and 3,807,157). This well known arrangement has the disadvantage that the spinning rotor occupies no clearly defined position in the axial direction, because the support is pressed out of its intended position by means of the axial thrust. The reason for this is that the support is not so massive (owing to expense) as to be able to compensate for the axial thrust.

SUMMARY OF THE INVENTION

The invention includes the mounting for the shaft of an open-end spinning rotor which by means of an axial thrust is pressed at its end against a ball that is carried by a unilaterally attached support. A stabilizing means contacts the support in a direction opposite from the direction of the axial thrust of the shaft on the support. The stabilizing means includes a set screw which contacts the support on an opposite side from a shaft in close proximity to the contact point of the shaft.

Accordingly, it is an object of the present invention to provide a stabilizing means for a bearing support that counteracts the axial thrust of the shaft of an open-end spinning machine.

Another important object of the present invention is to provide a mounting that maintains a spinning rotor shaft of an open-end spinning machine in its intended axial position.

These and other objects and advantages of the invention will become apparent upon reference to the following specification, attendant claims and drawing.

BRIEF DESCRIPTION OF THE DRAWING

The drawing is a sectional view of the mounting constructed in accordance with the present invention.

DESCRIPTION OF THE PREFERRED EMBODIMENT

One embodiment is illustrated with the aid of the attached drawing in which 1 denotes a housing in which is arranged the thrust bearing for a shaft 2 of an open-ended spinning rotor. The shaft 2, in a well-known and not fully described manner, is supported in the V-shaped groove of a pair of support disks and extends into the housing 1. An axial thrust is applied to the shaft 2 by arbitrary means so that it is pressed at its end against a ball 3, that is carried on a support 4 in close proximity to its free end. The other end of the support 4 is attached to a wall of the housing 1 by means of a screw 5. In order to prevent the ball 3 from falling out of the holder 4 when the spinning rotor is at a standstill and the axial thrust is therefore absent, a retaining socket 6 is attached to the free end of the support 4.

Associated with the support 4 is a stabilizing means 7, which in the embodiment consists of a setscrew 70 with nut 71 in contact with the support 4 in close proximity to the ball 3. In a given case, however, the stabilizing means 7 also can be a nonadjustable stop. The use of a setscrew as stabilizing means is preferred because with it the position of the support 4 can be changed in the direction toward the shaft 2 and opposite this direction for adjusting the alignment of the spinning rotors. The axial alignment can also compensate for the non-exact alignment of individual bearing blocks of the spinning rotors with respect to one another.

While a preferred embodiment of the invention has been described using specific terms, such description is for illustrative purposes only, and it is to be understood that changes and variations may be made without departing from the spirit or scope of the following claims.

What is claimed is:

1. A mounting for the shaft of an open-end spinning rotor which by means of an axial thrust is pressed at its end against a ball that is carried by a unilaterally attached support providing a contact point between said ball and said end of said shaft comprising:

a stabilizing means 7 directly contacting said support in a direction opposite the direction of the axial thrust of said shaft 2 on said support; said stabilizing means 7 being arranged to engage said support at a point in close proximity to said ball and the contact point of said shaft so as to counteract said axial thrust and maintain said shaft in its intended axial position.

2. The mounting according to claim 1 further comprising:

said stabilizing means 7 includes a setscrew 70, 71 in contact with the support 4.

* * * * *